US007928939B2

(12) United States Patent
Chung et al.

(10) Patent No.: US 7,928,939 B2
(45) Date of Patent: Apr. 19, 2011

(54) DISPLAY SYSTEM

(75) Inventors: Jerry Chung, Mountain View, CA (US); Wei Yao, Fremont, CA (US); Wei Chen, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 722 days.

(21) Appl. No.: 11/677,656

(22) Filed: Feb. 22, 2007

(65) Prior Publication Data

US 2008/0204431 A1 Aug. 28, 2008

(51) Int. Cl.
*G09G 3/32* (2006.01)

(52) U.S. Cl. ..... 345/82; 345/204; 345/691

(58) Field of Classification Search ..... 345/204, 345/55, 82, 87, 102, 691
See application file for complete search history.

(56) References Cited

U.S. PATENT DOCUMENTS 5,526,012 A * 6/1996 Shibahara ..... 345/92
6,256,025 B1 * 7/2001 Imai et al. ..... 345/211
6,326,964 B1 12/2001 Snyder et al.
6,987,400 B2 1/2006 Toro-Lira
6,987,787 B1 1/2006 Mick
7,079,123 B2 7/2006 Shino et al.
7,088,318 B2 8/2006 Malmberg
7,091,738 B2 8/2006 Nakano et al.
2002/0000960 A1 * 1/2002 Yoshihara et al. ..... 345/87
2002/0167474 A1 * 11/2002 Everitt ..... 345/82
2004/0164974 A1 8/2004 Son et al.
2005/0190165 A1 9/2005 Wendling
2006/0087247 A1 * 4/2006 Malmberg ..... 315/169.2
2006/0221036 A1 * 10/2006 Ookawara et al. ..... 345/95

OTHER PUBLICATIONS

International Search Report and Written Opinion for PCT/US08/54764, mailed Aug. 1, 2008, 9 pages.

* cited by examiner

*Primary Examiner* — Amare Mengistu
*Assistant Examiner* — Koosha Sharifi
(74) *Attorney, Agent, or Firm* — Morrison & Foerster LLP

(57) ABSTRACT

A display system is provided including forming a display array, connecting a control block to the display array, configuring a communication protocol between the display array and the control block, and operating the display array with the communication protocol.

25 Claims, 8 Drawing Sheets

DISPLAY SYSTEM

TECHNICAL FIELD

The present invention relates generally to display systems and more particularly to control of the display systems.

BACKGROUND ART

In the world of consumer devices, and particularly consumer electronics, there is an ever-present demand for improved appearance, improved functionality, greater efficiency, greater durability, lower cost, and improved aesthetics. Industrial design has become a highly skilled profession that focuses on fulfilling this need for enhanced consumer product appearance, functionality, and aesthetics.

One area that continually receives great attention for improvement is user displays. Providing crisp, attractive, unambiguous, and intuitively friendly displays and information for the user is very important in many consumer products. However, consumer products constantly diametrically pull display requirements both to be smaller for some products while to be larger for other products. Consumers also expect ever improving performance and reliability with ever decreasing cost.

Numerous technologies have been developed to meet these requirements. Some of the research and development strategies focus on new technologies while others focus on improving the existing and mature technologies. Research and development in the existing technologies may take a myriad of different directions.

One approach uses Cold Cathode Fluorescent Lamp (CCFL) as a backlight for liquid crystal displays (LCD). The CCFL approach has a number of drawbacks, such as scalability, brightness variation over time, toxic material, and robustness. Contemporary display products may range from very large displays for large sports arenas to a desktop form factor to a portable appliance. CCFL display architectures do not scale well for the broad range of form factors required by the various display applications. Another drawback with the CCFL approach is brightness degradation over time from a number of potential causes, such as reduction of emission mix, ballast failure, phosphor efficiency drop, or mercury absorption.

A more recent approach has attempted to use light emitting diodes (LED) for displays. Early LED applications in displays are found in hand held calculators with numeric LED displays. More recent LED applications have LED as backlights for small displays, such as hand-held devices like cell phones and personal data assistants (PDAs). Other LED applications in larger displays, such as display panels, involve complex wiring to each individual LED. The applications of LED in a broad range of displays therefore continue to present numerous challenges, such as increased complexity, limited format factor scaling, increased manufacturing costs, and reduced manufacturing yields.

Thus, a need still remains for a display system providing low cost manufacturing, improved yield, and improved reliability for the display systems. In view of the ever-increasing need to save costs and improve efficiencies, it is more and more critical that answers be found to these problems.

Solutions to these problems have been long sought but prior developments have not taught or suggested any solutions and, thus, solutions to these problems have long eluded those skilled in the art.

DISCLOSURE OF THE INVENTION

The present invention provides a display system including forming a display array, connecting a control block to the display array, configuring a communication protocol between the display array and the control block, and operating the display array with the communication protocol.

Certain embodiments of the invention have other aspects in addition to or in place of those mentioned or obvious from the above. The aspects will become apparent to those skilled in the art from a reading of the following detailed description when taken with reference to the accompanying drawings.

BEST MODE FOR CARRYING OUT THE INVENTION

Figure 1A:
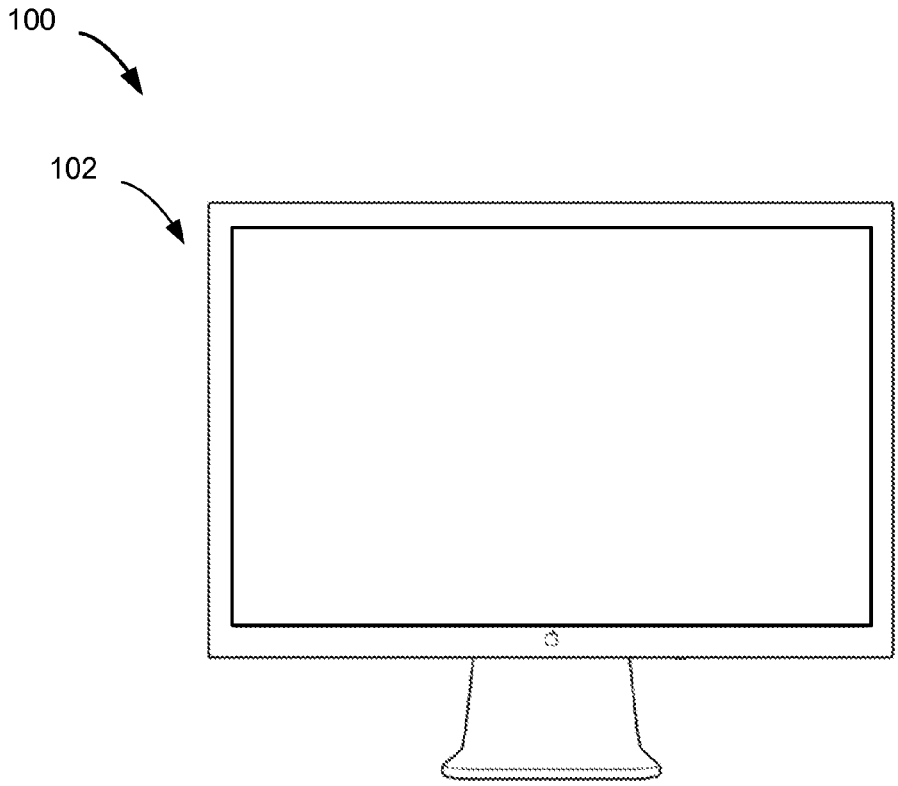
FIGS. 1A, 1B, and 1C are views of display systems incorporating an embodiment of the present invention.

In the following description, numerous specific details are given to provide a thorough understanding of the invention. However, it will be apparent that the invention may be practiced without these specific details. In order to avoid obscuring the present invention, some well-known system configurations, and process steps are not disclosed in detail. Likewise, the drawings showing embodiments of the apparatus are semi-diagrammatic and not to scale and, particularly, some of the dimensions are for the clarity of presentation and are shown greatly exaggerated in the figures. In addition, where multiple embodiments are disclosed and described having some features in common, for clarity and ease of illustration, description, and comprehension thereof, similar and like features one to another will ordinarily be described with like reference numerals.

The term "horizontal" as used herein is defined as a plane parallel to the conventional integrated circuit surface, regardless of its orientation. The term "vertical" refers to a direction perpendicular to the horizontal as just defined. Terms, such as "above", "below", "bottom", "top", "side" (as in "sidewall"), "higher", "lower", "upper", "over", and "under", are defined with respect to the horizontal plane. The term "on" means there is direct contact among elements.

The term "system" means the method and the apparatus of the present invention. The term "processing" as used herein includes deposition of material, patterning, exposure, development, etching, cleaning, molding, and/or removal of the material or as required in forming a described structure.

Figure 1B:
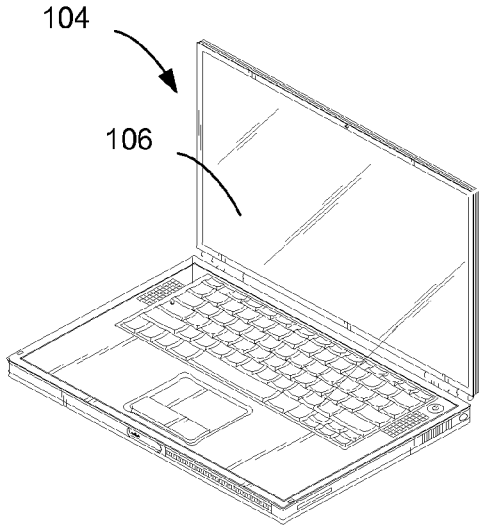
Figure 1C:
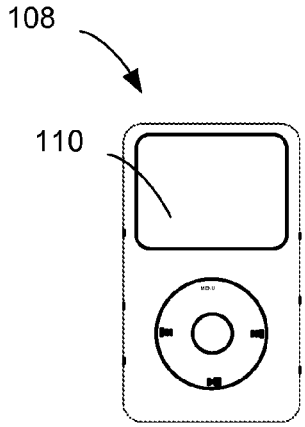

Referring now to FIGS. 1A, 1B, and 1C, therein are shown views of display systems 100 incorporating an embodiment of the present invention. The display systems 100 depicts a stand-alone display 102, a compute device 104 having a terminal display 106, and a hand held device 108 having a miniature screen 110.

The stand-alone display 102, such as a light emitting diode (LED) flat panel, may serve as a cinema display receiving image input from different sources, such as cable television or from a compute device 104. The compute device 104, such as a laptop computer or a computer desktop, may be connected to the stand-alone display 102 serving as an external display panel. The compute device 104 in the case of a laptop computer has the terminal display 106, such as a laptop screen, for use without the stand-alone display 102. The hand held device 108, such as a portable music/video player, personal digital assistant, or a cellular phone, may connect to the compute device 104 or the stand-alone display 102 to source or store information.

For illustrative purposes, the stand-alone display 102, the compute device 104, and the hand held device 108 are shown as examples of the display systems 100, although it is understood that the display systems 100 may differ, such as a large display for use in a sport arena. Also for illustrative purposes, the display systems 100 are shown as consumer products, although it is understood that the display systems 100 may be products for other markets or applications, such as enterprise or military products.

Figure 2:
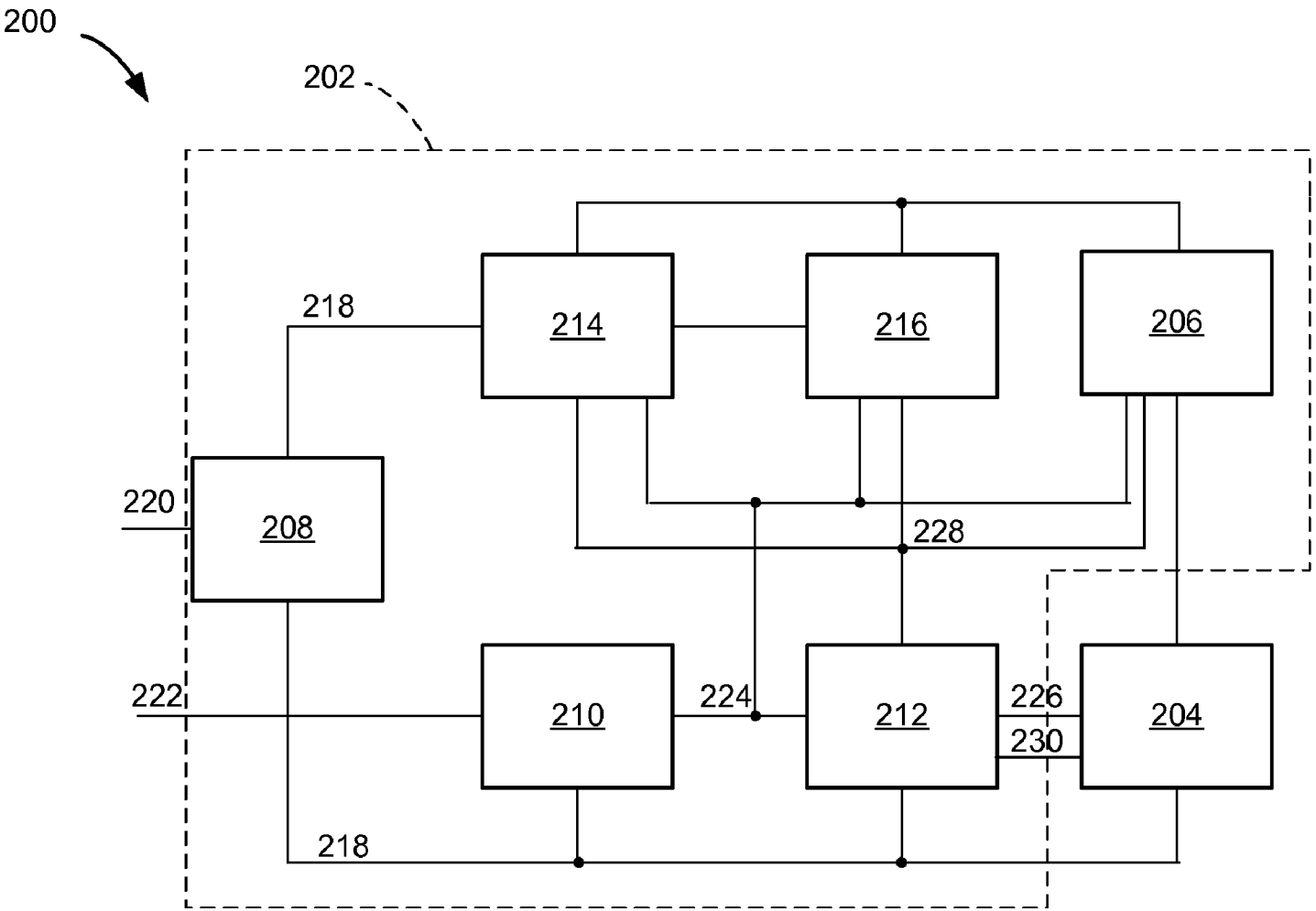
FIG. 2 is a block diagram view of a display control system of the display system of FIG. 1 in an embodiment of the present invention.

Referring now to FIG. 2, therein is shown a block diagram view of a display control system 200 of the display systems 100 of FIG. 1 in an embodiment of the present invention. The display control system 200 has control blocks 202 and a display 204. The control blocks 202 include a power supply 206, a timing generator 208, a media interface 210, a display interface 212, a controller 214, and a memory 216. The display 204, such as an active matrix LED display or an active matrix display with LED backlight, may represent various types of displays similar to the stand-alone display 102 of FIG. 1, the terminal display 106 of FIG. 1, and the miniature screen 110 of FIG. 1.

As will be described more in detail later, the control blocks 202 provide the interface from media sources, such as cable television or compute devices, and the display 204. The control blocks 202 include operation circuitry, configuration circuitry, transfer circuitry, and signaling circuitry. These circuitry provide access and information transfer to the display 204 with predetermined protocols, such as an access protocol and information transfer protocol. The signaling circuitry may include a modulation circuitry, such as a pulse width modulation circuitry, amplitude modulation circuitry, or a hybrid circuit providing both pulse width modulation and amplitude modulation. These aforementioned circuitry may be partitioned and implemented in a number of different manners. The following is an example of an implementation used to provide the functions of the circuitry mentioned above.

The power supply 206 may be a programmable or variable power source providing different power types, such as voltage supply, current supply, voltage reference, current reference, ground reference, or a combination thereof. The power supply 206 provides predetermined power to the timing generator 208, the media interface 210, the display interface 212, the controller 214, the memory 216, and the display 204. The power supply 206 may be implemented by various implementations, such as a battery, switched power supply, a linear power supply, or a combination of different types.

The timing generator 208 provides function signals 218, such as clocks or resets, to the functional blocks of the display control system 200. An external signal reference 220, such as a clock reference or configuration setting, may be an input to the timing generator 208 for generating the function signals 218. The timing generator 208 may function without the external signal reference 220. The timing generator 208 may be implemented by various implementations, such as clock generators, phase lock loops (PLL), voltage controlled oscillators (VCO), or power on reset (POR) circuits.

For illustrative purposes, the timing generator 208 is described above receiving an optional input of the external signal reference 220 and generating the function signals 218, although it is understood that other inputs and outputs are possible for the timing generator 208, such as an output of a voltage sensor monitoring the power supply 206 to generate hard resets. Also for illustrative purposes, the timing generator 208 is shown as a single block, although it is understood that the functions of the timing generator 208 may be implemented in different blocks or in other functional blocks, such as the controller 214.

The media interface 210, such as a video formatter, receives a media signal 222, such as video in, control signals, power from the power supply 206 (connection not shown), and a portion of the function signals 218 from the timing generator 208. The media interface 210 performs operations, such as formatting or parsing, with the media signal 222 and delivers processed information 224, such as video picture information, control signals, status information, brightness information, and/or addressing information, to the controller 214, the memory 216, and the display interface 212. For illustrative purposes, the processed information 224 are shown connected between the media interface 210 and the other blocks in the control blocks 202, although it is understood that the processed information 224 may connect with the other blocks differently.

The display interface 212 provides the physical interface to and from the display 204. The display interface 212 receives the processed information 224 from the media interface 210 and may perform additional processing before generating display ingress information 226, such as pixel address, picture data, or display control signals, to the display 204 as well as other display interface information 228 to the controller 214, the media interface 210, and the memory 216. The display interface 212 may also receive display egress information 230, such as voltage or current feedback information, from the display 204 for providing feedback information in the display control system 200.

The display interface 212 may include display drivers (not shown) of different sizes and drive strengths. The display interface 212 may also include display receivers (not shown), such as current sensors or voltage sensors, to receive the display egress information 230. The display interface 212 may include conversion circuitry (not shown), such as analog to digital converters (ADC), digital to analog converters (DAC), or level shifters, to translate different signaling types between the display 204 and the rest of the display control system 200.

The display interface 212 may be modularized and selected for the type of the display 204. For example, if the display 204 is a large display used in a large sport arena, the number of the display drivers and the drive strengths may be substantially different compared to the display drivers for the miniature screen 110 of FIG. 1 for the hand held device 108 of FIG. 1. For illustrative purposes, the media interface 210 and the display interface 212 are depicted as different blocks, although it is understood that the functional partition may differ or the media interface 210 and the display interface 212 may be implemented in a single device.

The controller 214, such as a processor, a microcontroller, an application specific integrated circuit, or a computing device, provides overall functional control of the display control system 200. The controller 214 interacts with the timing generator 208, the power supply 206, the media interface 210, and the display interface 212.

The controller 214 may adjust the power supply 206 to provide predetermine power types and levels to various functional blocks of the display control system 200. For example, the controller 214 may adjust the power supply 206 to increase or decrease the power levels to the display interface 212 and the display 204 in order to increase or decrease the brightness, respectively. The controller 214 may also direct memory management of the memory 216. The controller 214 may adjust parameters in the media interface 210, the display interface 212, the power supply 206, and the memory 216 for normal operation, test, or calibration.

The memory 216, such as a nonvolatile or volatile memory, may store code, configuration, and status. The memory 216 may also serve as a data buffer to compensate for the different transfer rates in the display control system 200 or to alleviate resource conflicts. For illustrative purposes, the memory 216 is depicted as a separate block, although it is understood that the memory 216 may not be implemented in a separate device, such as partially or completely integrated into the controller 214.

For illustrative purposes, the display control system 200 is shown with a partition of the timing generator 208, the power supply 206, the media interface 210, the display interface 212, the controller 214, the memory 216, and the display 204, although it is understood that the display control system 200 may have a different functional partition, such as a single integrated circuit device performing the aforementioned operations. Also for illustrative purposes, the display control system 200 is depicted as having electronic devices, although it is understood that other types of specialized devices or structures may be part of the display control system 200. Further, although the functions and relationships of the blocks in display control system 200 are described for illustrative purposes, it will be understood by one of ordinary skill in the art that not all functions have been described and that the functions may differ.

Figure 3:
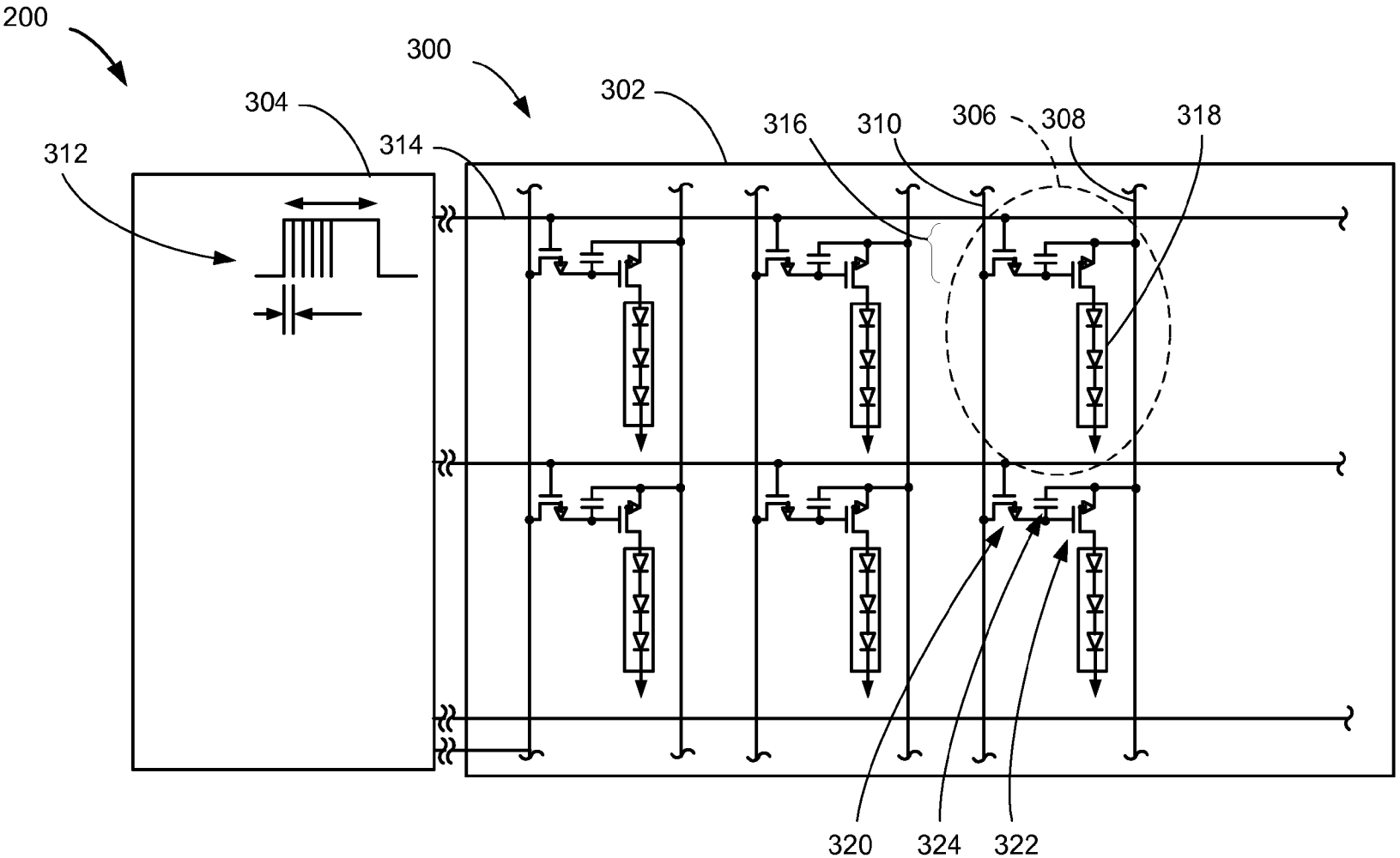
FIG. 3 is a more detailed view of a display in the display control system of FIG. 2 in an embodiment of the present invention.

Referring now to FIG. 3, therein is shown a more detailed view of a display 300 in the display control system 200 of FIG. 2 in an embodiment of the present invention. The display 300 may represent the display 204 of FIG. 2. A display array 302 is a portion of the display 300. Control blocks 304 may represent the control blocks 202 of FIG. 2 in the display control system 200.

The display array 302 has display units 306 in a matrix configuration. The display array 302 may be used to provide direct display or backlight for a display panel. A power line 308 and a serial protocol line 310 are connected to each of the display units 306. The serial protocol line 310 provides operational information, such as column address select, normal operation select, brightness information, test mode select, test data, calibration select, calibration data, as well as image information. The serial protocol line 310 may provide various information types or commands by a signal protocol recognized by the display units 306. The signal protocol may include a modulation scheme with varying duty cycles, amplitudes, levels, aperiodicity, frequencies, or a combination thereof. The signal protocol may include varying modulation schemes with structured sequences designating partitions in the signal protocol. One example of a signal for the serial protocol line 310 is a pulse width modulation signal 312 as depicted by a waveform in the control blocks 304.

For illustrative purposes, the serial protocol line 310 is depicted as a serial line providing a transmission medium for the pulse width modulation signal 312, although it is understood that the serial protocol line 310 may include multiple lines each having an independent serial protocol. Also for illustrative purposes, although the serial protocol line 310 is depicted as a serial line, it is understood that the information carried on the serial protocol line 310 may be accomplished by multiple lines in a different connection topology, such as a parallel bus.

Each of the display units 306 is connected to an access line 314, such as a row address line, for enabling operation prescribed by the pulse width modulation signal 312 on the serial protocol line 310. The pulse width modulation signal 312 and the signal on the access line 314 are part of the display ingress information 226 of FIG. 2. The power line 308 is from the power supply 206 of FIG. 2.

The control blocks 304 generate the signals for the serial protocol line 310 and the access line 314. A communication link between the control blocks 304 and the display 300 includes the serial protocol line 310 and the access line 314, wherein the communication link carries a communication protocol.

Each of the display units 306 has activation elements 316 and an illumination element 318. The activation elements 316 include an access switch 320, an illumination switch 322, and a storage element 324. The access switch 320, such as a field effect transistor (FET), provides or blocks access to the instance of the display units 306 for operation prescribed by the serial protocol line 310. The illumination switch 322, such as a field effect transistor (FET), provides or blocks activation of the illumination element 318. The storage element 324, such as a capacitor, stores information from the serial protocol line 310 that passed through the access switch 320.

For illustrative purposes, the activation elements 316 are depicted as multiple elements, although it is understood that the activation elements 316 may be a single element providing the functions of the access switch 320 and the illumination switch 322. Also for illustrative purposes, the activation elements 316 are depicted as functionally partitioned into the access switch 320 and the illumination switch 322, although it is understood that the activation elements 316 for each of the display units 306 may be partitioned differently.

The illumination element 318, such as a light emitting diode (LED) of incoherent or coherent photon emission, provides the light for the display 300. The illumination element 318 may be implemented in a number of different configurations, such as a single light emitting diode, a string of light emitting diodes, a tree of light emitting diodes, or a matrix of light emitting diodes. A string of light emitting diodes is typically of the same type, such as having similar electrical characteristics and substantially the same color. A tree or matrix of light emitting diodes may have light emitting diodes of different types, such as having different electrical characteristics and different color, but not typically in the same string. The illumination element 318 may represent a pixel or multiple pixels depending on the configuration of the illumination element 318.

The access line 314 is connected to a gate terminal of the access switch 320. The serial protocol line 310 is connected to a source terminal of the access switch 320. A drain terminal of the access switch 320 is connected to a gate terminal of the illumination switch 322 and an electrode of the storage element 324. The other electrode of the storage element 324 is connected to the power line 308 and to a source terminal of the illumination switch 322. Althernatively, the other electrode of the storage element 324 may be connected to ground. A drain terminal of the illumination switch 322 is connected to an anode of the illumination element 318. A cathode of the illumination element 318 is connected to a voltage reference, such as a ground, having lower potential than that on the power line 308.

For illustrative purposes, the access switch 320 is shown as a transistor, although it is understood that the access switch 320 may be an apparatus that provides a switching function that is not a transistor, such as a specialized electrical switch, non-electrical switch, or a combination of both. Also for illustrative purposes, the illumination switch 322 is shown as a transistor, although it is understood that the illumination switch 322 may be an apparatus that provides a switching function of a current source that is not a transistor, as a specialized electrical switch, non-electrical switch, or a combination of both. Further for illustrative purposes, the storage element 324 is shown as a capacitor, although it is understood that the storage element 324 may be a different storage apparatus, such as a specialized electrical storage element, a non-electrical storage element, or a combination of both.

The operation of the display units 306 in the display array 302 is discussed in more detail below. The control blocks 304 select a row of the display units 306 by generating the predetermined row address on the access line 314. The addresses for the other rows of the display units 306 in the display array 302 are not generated, thereby not selecting those rows.

The control blocks 304 generate the pulse width modulation signal 312 on the serial protocol line 310 that is connected to the display units 306. The serial protocol line 310 for each column of the display units 306 may have the same or different information. The predetermined information from the pulse width modulation signal 312 on the serial protocol line 310 passes through the access switch 320 that is enabled by the access line 314 and provides control of the illumination switch 322.

The pulse width modulation signal 312 determines the activation time, denoted by a notation T, and non-activation time of the illumination element 318 as well as controls a luminance of the illumination element 318. The pulse width modulation signal 312 may be further characterized by a resolution of the activation time by n bits and the increment of the pulse width modulation signal 312 of $T/2^n$.

Each scan of the display array 302 has the illumination switch 322 in either "on" or "off" state. The "on" state has the pulse width modulation signal 312 passing between the source terminal and the drain terminal of the illumination switch 322. The "off" state blocks information transfer between the source terminal and the drain terminal of the illumination switch 322. One pulse width modulation cycle is completed with $2^n$ scans of the display array 302. The duty ratio of the activation time, such as the "on" state, and the non-activation time, such as the "off" state, of the pulse width modulation signal 312 determines the number of "on" and "off" scans.

The pulse width modulation signal 312 on the serial protocol line 310 is passed through the access switch 320 that is enabled by the access line 314 and is stored on the storage element 324. The stored information, such as charge, in the storage element 324 serves as a bias voltage to the illumination switch 322 between scans. The bias voltage determines the state, such as "on" or "off", of the illumination switch 322 and whether current flows through the illumination switch 322 during each scan. Current through the illumination switch 322 allows current through the illumination element 318 causing photon emission, wherein the illumination switch 322 serves as a current source. The control of the "on" and "off" states ratio of the illumination switch 322 in the activation time, such as T, along with the pulse width modulation signal duty ratio defines the luminance of the illumination element 318.

By controlling the ratio of "on" and "off" states of the illumination switch 322 in the activation time, such as T, the duty ratio of the pulse width modulation signal 312 and the luminance are defined.

For example, if T=2.56 ms and n=8, 256 scans complete one pulse width modulation cycle with each scan at 10 μs. For the illumination switch 322 to drive the illumination element 318 at 25% duty ratio, the pulse width modulation signal 312 turns "on" the illumination switch 322 64 scans of the 256 scans and turns "off" the illumination switch 322 192 scans of the 256 scans.

The control blocks 304 may convert the display ingress information 226 and the display egress information 230 of FIG. 2 to the pulse width modulation signal 312 by a number of different processes. The control blocks 304 may utilize the blocks of the display control system 200 in a number of different ways for the conversion process.

For example, the controller 214 of FIG. 2 may convert the display ingress information 226 to the pulse width modulation signal 312 on the serial protocol line 310 using programmed input/output (PIO) with a specialized port or a general purpose input/output port of the controller 214. The controller 214 may also have a specialized hardware protocol interface to perform the conversion. The controller 214 may also have specialized protocols, such as request-acknowledge hand shake, between the other blocks of the display control system 200 directing the other blocks to perform the conversion.

Another example of the conversion process and apparatus is that the specialized hardware protocol interface may be part of the media interface 210 of FIG. 2 or the display interface 212 of FIG. 2 as well as part of the controller 214. The specialized hardware protocol interface may include counters of n-bits, a shift register of n-bits to implement the $2^n$ function, or both. The specialized hardware protocol interface may also be implemented with finite state machines that may include or may interact with the n-bit counter and shift register.

Yet another example of the conversion process and apparatus is utilizing more analog circuitry. An operational amplifier (op amp) may be used as a comparator where one input is connected to a voltage reference, such as reference for turning the output of the operational amplifier "on" or "off", and the other input connected to a voltage ramp. The voltage reference value, the voltage ramp slope, or both may be programmable to provide the pulse width modulation signal 312 on the serial protocol line 310.

Figure 4:
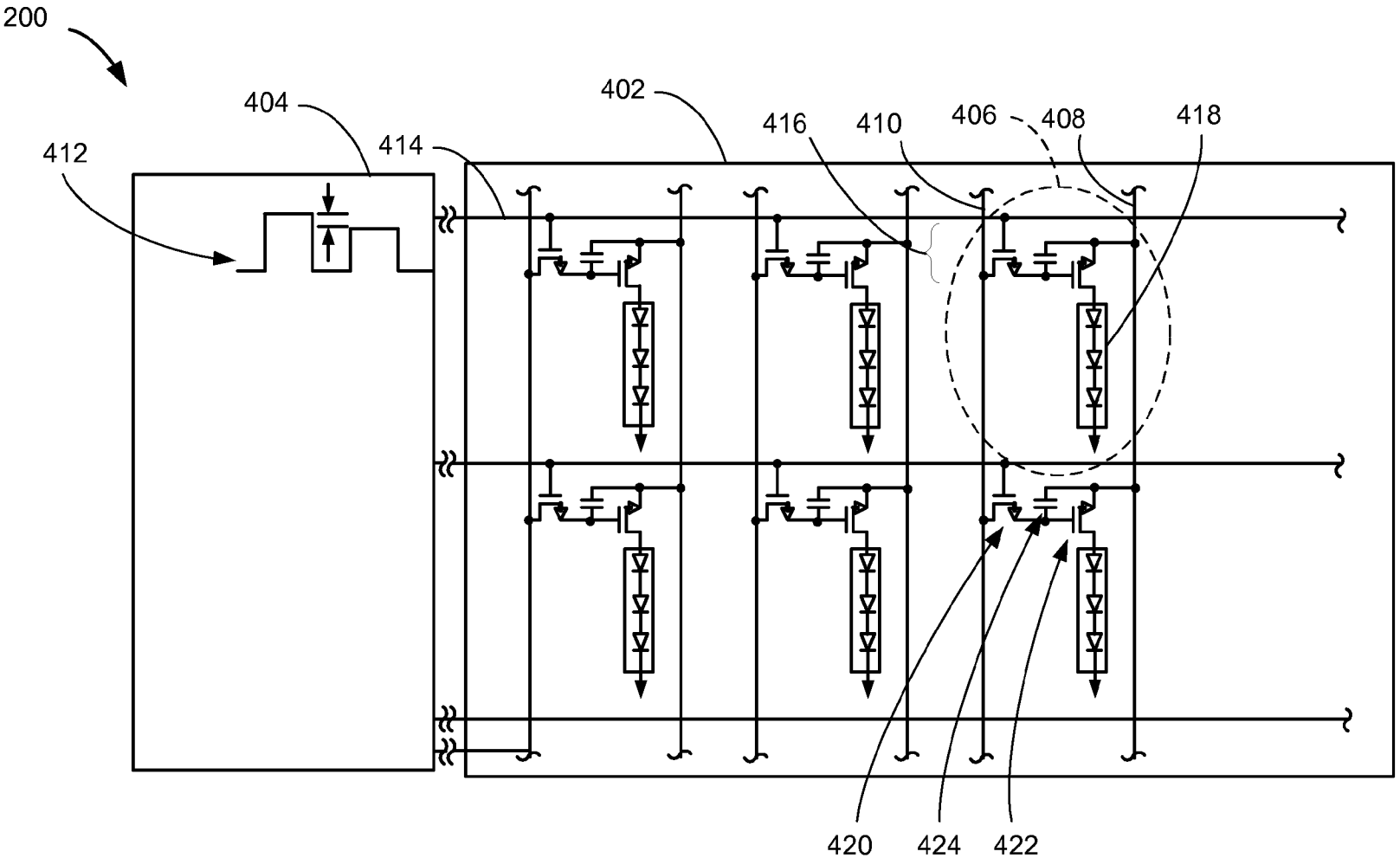
FIG. 4 is a more detailed view of a display in the display control system of FIG. 2 in an alternative embodiment of the present invention.

Referring now to FIG. 4, therein is shown a more detailed view of a display 400 in the display control system 200 of FIG. 2 in an embodiment of the present invention. The display 400 may represent the display 204 of FIG. 2. A display array 402 is a portion of the display 400. Control blocks 404 may represent the control blocks 202 of FIG. 2 in the display control system 200.

The display array 402 has display units 406 in a matrix configuration. The display array 402 may be used to provide direct display or backlight for a display panel. A power line 408 and a serial protocol line 410 are connected to each of the display units 406. The serial protocol line 410 provides operational information, such as column address select, normal operation select, brightness information, test mode select, test data, calibration select, calibration data, as well as image information. The serial protocol line 410 may provide various information types or commands by a signal protocol recognized by the display units 406. The signal protocol may include a modulation scheme with varying duty cycles, amplitudes, levels, aperiodicity, frequencies, or a combination thereof. The signal protocol may include varying modulation schemes with structured sequences designating partitions in the signal protocol. One example of a signal for the serial protocol line 410 is an amplitude modulation signal 412 as depicted by a waveform in the control blocks 404.

Each of the display units 406 is connected to an access line 414, such as a row address line, for enabling operation prescribed by the amplitude modulation signal 412 on the serial protocol line 410. The amplitude modulation signal 412 and the signal on the access line 414 are part of the display ingress information 226 of FIG. 2. The power line 408 is from the power supply 206 of FIG. 2.

The control blocks 404 generate the signals for the serial protocol line 410 and the access line 414. A communication link between the control blocks 404 and the display 400 includes the serial protocol line 410 and the access line 414, wherein the communication link carries a communication protocol.

Each of the display units 406 has activation elements 416 and an illumination element 418. The activation elements 416 include an access switch 420, an illumination switch 422, and a storage element 424. The access switch 420, such as a field effect transistor (FET), provides or blocks access to the instance of the display units 406 for operation prescribed by the serial protocol line 410. The illumination switch 422, such as a field effect transistor (FET), provides or blocks activation of the illumination element 418. The storage element 424, such as a capacitor, stores information from the serial protocol line 410 that passed through the access switch 420.

The illumination element 418, such as a light emitting diode (LED) of incoherent or coherent photon emission, provides the light for the display 400. The illumination element 418 may be implemented in a number of different configurations, such as a single light emitting diode, a string of light emitting diodes, a tree of light emitting diodes, or a matrix of light emitting diodes.

The access line 414 is connected to a gate terminal of the access switch 420. The serial protocol line 410 is connected to a source terminal of the access switch 420. A drain terminal of the access switch 420 is connected to a gate terminal of the illumination switch 422 and an electrode of the storage element 424. The other electrode of the storage element 424 is connected to the power line 408 and to a source terminal of the illumination switch 422. A drain terminal of the illumination switch 422 is connected to an anode of the illumination element 418. A cathode of the illumination element 418 is connected to a voltage reference, such as a ground, having lower potential than that on the power line 408.

The operation of the serial protocol line 410 with the display units 406 may be similar to the serial protocol line 310 of FIG. 3 with the display units 306 of FIG. 3. As mentioned earlier, the serial protocol line 410 may transmit the amplitude modulation signal 412. The amplitude may be modulated on the serial protocol line 410 passing through the access switch 420 and stored in the storage element 424. The charge stored on the storage element 424 is dependent on the amplitude on the serial protocol line 410 and serves as an analog bias voltage for the illumination switch 422. The analog bias voltage on the gate terminal of the illumination switch 422 limits the flow of information, such as current, through the illumination switch 422. The illumination switch 422 serves as a controlled current source resulting in the luminance of the illumination element 418. The current through the illumination switch 422 may be adjusted with each scan of the display array 402.

The control blocks 404 may convert the display ingress information 226 and the display egress information 230 of FIG. 2 to the amplitude modulation signal 412 by a number of different processes. The control blocks 404 may utilize the blocks of the display control system 200 in a number of different ways for the conversion process.

For example, the controller 214 of FIG. 2 may convert the display ingress information 226 to the amplitude modulation signal 412 on the serial protocol line 410 using programmed input/output (PIO) with a specialized port or a general purpose input/output port of the controller 214. The controller 214 may also have a specialized hardware protocol interface to perform the conversion. The controller 214 may also have specialized protocols, such as request-acknowledge hand shake, between the other blocks of the display control system 200 directing the other blocks to perform the conversion.

Another example of the conversion process and apparatus is that the specialized hardware protocol interface that may be part of the media interface 210 of FIG. 2 or the display interface 212 of FIG. 2 as well as part of the controller 214. The specialized hardware protocol interface may include counters of n-bits, a shift register of n-bits to implement the $2^n$ function, or both. The specialized hardware protocol interface may also be implemented with finite state machines that may include or may interact with the n-bit counter and shift register.

Yet another example of the conversion process and apparatus is utilizing more analog circuitry. An operational amplifier (op amp) may be used as a comparator where one input is connected to a voltage reference, such as a reference for turning the output of the operational amplifier "on" or "off" and the other input connected a voltage ramp. The voltage reference value, the voltage ramp slope, or both may be programmable to provide the amplitude modulation signal 412 on the serial protocol line 410.

Figure 5:
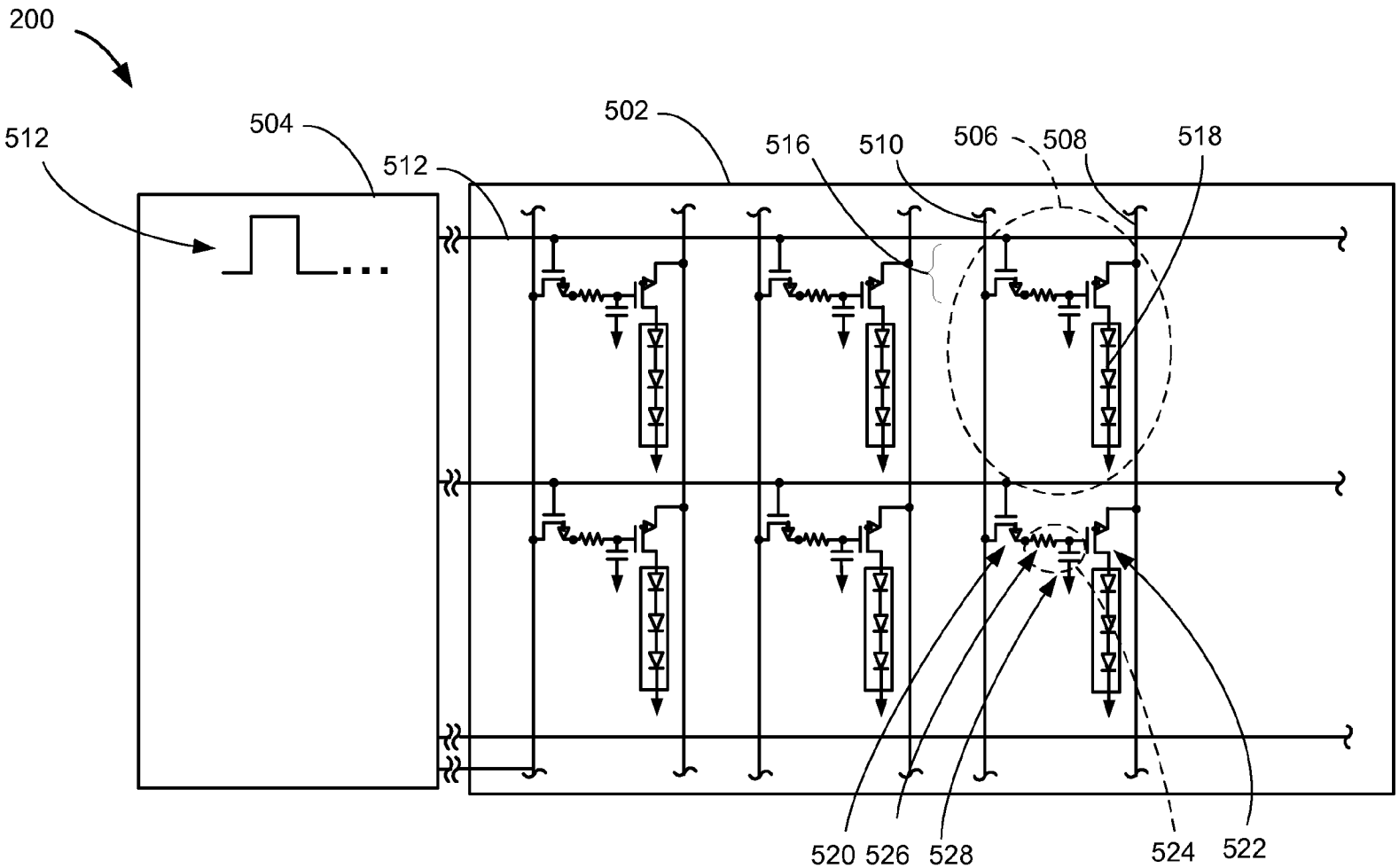
FIG. 5 is a more detailed view of a display in the display control system of FIG. 2 in another alternative embodiment of the present invention.

Referring now to FIG. 5, therein is shown a more detailed view of a display 500 in the display control system 200 of FIG. 2 in an embodiment of the present invention. The display 500 may represent the display 204 of FIG. 2. A display array 502 is a portion of the display 500. Control blocks 504 may represent the control blocks 202 of FIG. 2 in the display control system 200.

The display array 502 has display units 506 instantiated in a matrix configuration. The display array 502 may be used to provide direct display or backlight for a display panel. A power line 508 and a serial protocol line 510 are connected to each of the display units 506. The serial protocol line 510 provides operational information, such as column address select, normal operation select, brightness information, test mode select, test data, calibration select, calibration data, as well as image information. The serial protocol line 510 may provide various information types or commands by a signal protocol recognized by the display units 506. The signal protocol may include a modulation scheme with varying duty cycles, amplitudes, levels, aperiodicity, frequencies, or a combination thereof. The signal protocol may include varying modulation schemes with structured sequences designating partitions in the signal protocol. One example of a signal for the serial protocol line 510 is a serial signal 512 as depicted by a waveform in the control blocks 504.

Each of the display units 506 is connected to an access line 514, such as a row address line, for enabling operation prescribed by the serial signal 512 on the serial protocol line 510. The serial signal 512 and the signal on the access line 514 are part of the display ingress information 226 of FIG. 2. The power line 508 is from the power supply 206 of FIG. 2. The control blocks 504 generate the signals for the serial protocol line 510 and the access line 514. A communication link between the control blocks 504 and the display 500 includes the serial protocol line 510 and the access line 514, wherein the communication link carries a communication protocol.

Each of the display units 506 has activation elements 516 and an illumination element 518. The activation elements 516 include an access switch 520, an illumination switch 522, and a storage element 524. The access switch 520, such as a field effect transistor (FET), provides or blocks access to the instance of the display units 506 for operation prescribed by the serial protocol line 5 10. The illumination switch 522, such as a field effect transistor (FET), provides or blocks activation of the illumination element 518. The storage element 524, such as a resistor and capacitor (RC) circuit, stores information from the serial protocol line 510 that passed through the access switch 520.

For illustrative purposes, the activation elements 516 are depicted as multiple elements, although it is understood that the activation elements 516 may be a single element providing the functions of the access switch 520 and the illumination switch 522. Also for illustrative purposes, the activation elements 516 are depicted as functionally partitioned into the access switch 520 and the illumination switch 522, although it is understood that the activation elements for each of the display units 506 may be partitioned differently.

The illumination element 518, such as a light emitting diode (LED) of incoherent or coherent photon emission, provides the light for the display 500. The illumination element 518 may be implemented in a number of different configurations, such as a single light emitting diode, a string of light emitting diodes, a tree of light emitting diodes, or a matrix of light emitting diodes.

The access line 514 is connected to a gate terminal of the access switch 520. The serial protocol line 510 is connected to a source terminal of the access switch 520. A drain terminal of the access switch 520 is connected to a terminal of a resistor 526 of the storage element 524. The other terminal of the resistor 526 is connected to a gate terminal of the illumination switch 522 and an electrode of a capacitor 528 of the storage element 524. The other electrode of the capacitor 528 is connected to a voltage reference, such as a ground, having lower potential than that on the power line 508.

The power line 508 is connected to a source terminal of the illumination switch 522. A drain terminal of the illumination switch 522 is connected to an anode of the illumination element 518. A cathode of the illumination element 518 is connected to a voltage reference, such as a ground, having lower potential than that on the power line 508.

For illustrative purposes, the access switch 520 is shown as a transistor, although it is understood that the access switch 520 may be an apparatus that provides a switching function that is not a transistor, such as a specialized electrical switch, non-electrical switch, or a combination of both. Also for illustrative purposes, the illumination switch 522 is shown as a transistor, although it is understood that the illumination switch 522 may be an apparatus that provides a switching function that is not a transistor, as a specialized electrical switch, non-electrical switch, or a combination of both. Further for illustrative purposes, the storage element 524 is shown as a capacitor, although it is understood that the storage element 524 may be a different storage apparatus, such as a specialized electrical storage element, a non-electrical storage element, or a combination of both.

The operation of the serial protocol line 510 with the access switch 520, the illumination switch 522, and the illumination element 518 is similar to the serial protocol line 310 of FIG. 3 with the access switch 320, the illumination switch 322, and the illumination element 318 of FIG. 3. The circuit formed by the resistor 526 and the capacitor 528 is a low pass filter. The low pass filter converts the serial signal 512 on the serial protocol line 510 to approximately direct current (DC) analog voltage. This DC analog voltage is linearly proportional to the duty ratio of the serial signal 512, such as a pulse width modulation signal, on the serial protocol line 510. The DC analog voltage is stored in the capacitor 528 when the access switch 520 is "off" and controls the current through the illumination switch 522.

The control blocks 504 provide the serial signal 512 on the serial protocol line 510 that is connected to the display units 506. The serial protocol line 510 for each column of the display units 506 may have the same or different information. The predetermined information, such as the duty cycle of the pulse width modulation signal, on the serial protocol line 510 passes through the access switch 520 that is enabled by the access line 514 and provides control of the illumination switch 522.

The control blocks 504 may convert the display ingress information 226 and the display egress information 230 of FIG. 2 in the display control system 200 to the serial signal 512 by a number of different processes, such as those described in FIG. 3. The control blocks 504 may utilize the blocks of the display control system 200 in a number of different ways for the conversion process, such as those described in FIG. 3.

Figure 6:
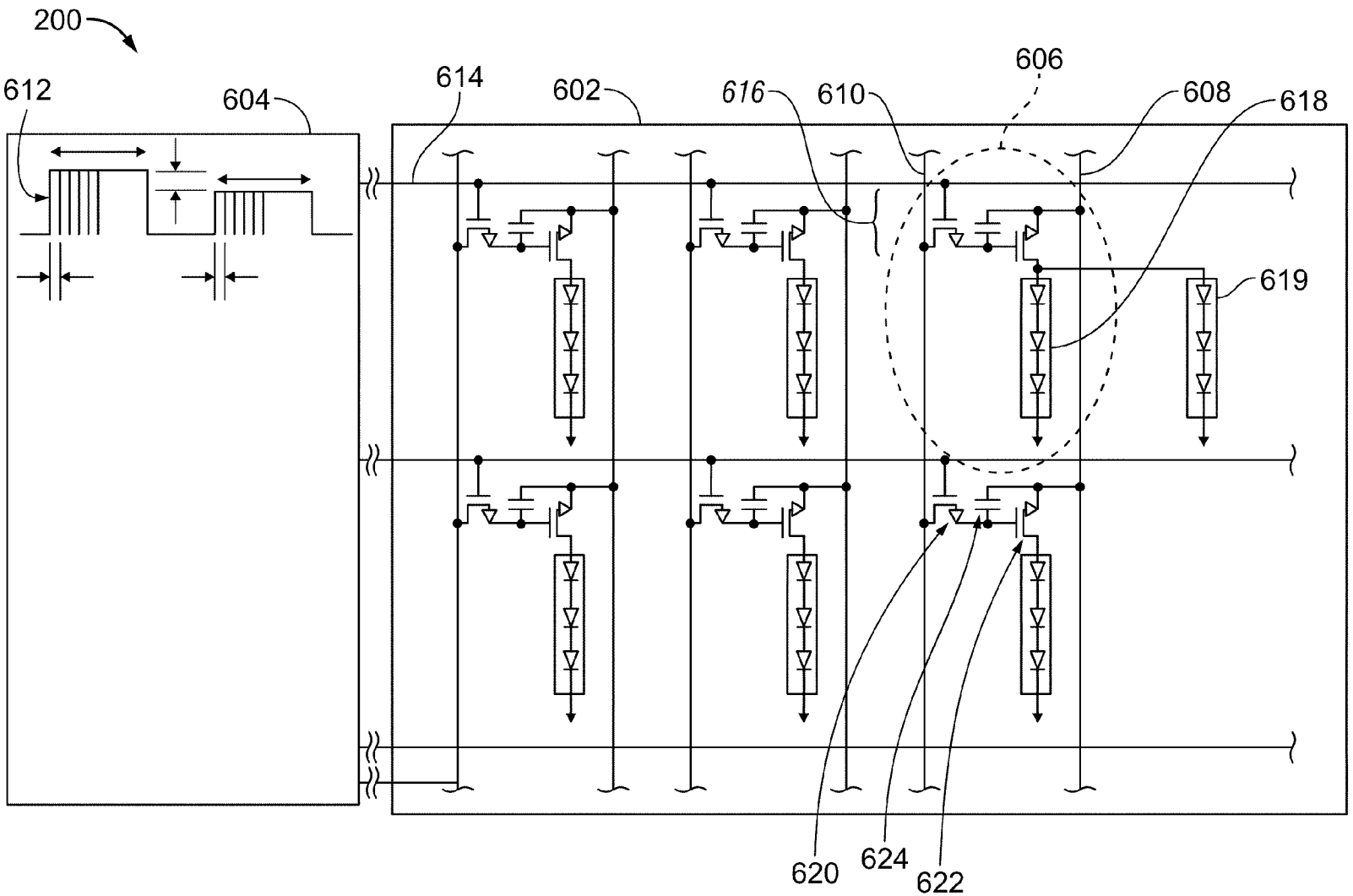
FIG. 6 is a more detailed view of a display in the display control system of FIG. 2 in yet another embodiment of the present invention.

Referring now to FIG. 6, therein is shown a more detailed view of a display 600 in the display control system 200 of FIG. 2 in an embodiment of the present invention. The display 600 may represent the display 204 of FIG. 2. A display array 602 is a portion of the display 600. Control blocks 604 may represent the control blocks 202 of FIG. 2 in the display control system 200.

The display array 602 has display units 606 instantiated in a matrix configuration. The display array 602 may be used to provide direct display or backlight for a display panel. A power line 608 and a serial protocol line 610 are connected to each of the display units 606. The serial protocol line 610 provides operational information, such as column address select, normal operation select, brightness information, test mode select, test data, calibration select, calibration data, as well as image information. The serial protocol line 610 may provide various information types or commands by a signal protocol recognized by the display units 606. The signal protocol may include a modulation scheme with varying duty cycles, amplitudes, levels, aperiodicity, frequencies, or a combination thereof. The signal protocol may include varying modulation schemes with structured sequences designating partitions in the signal protocol. One example of a signal for the serial protocol line 610 is a hybrid signal 612 including amplitude modulation and pulse width modulation as depicted by a waveform in the control blocks 604.

Each of the display units 606 is connected to an access line 614, such as a row address line, for enabling operation prescribed by the hybrid signal 612 on the serial protocol line 610. The hybrid signal 612 and the signal on the access line 614 are part of the display ingress information 226 of FIG. 2. The power line 608 is from the power supply 206 of FIG. 2.

The control blocks 604 generate the signals for the serial protocol line 610 and the access line 614. A communication link between the control blocks and the display 600 includes the serial protocol line 610 and the access line 614, wherein the communication link carries a communication protocol.

Each of the display units 606 has activation elements 616 and an illumination element 618. The activation elements 616 include an access switch 620, an illumination switch 622, and a storage element 624. The access switch 620, such as a field effect transistor (FET), provides or blocks access to the instance of the display units 606 for operation prescribed by the serial protocol line 610. The illumination switch 622, such as a field effect transistor (FET), provides or blocks activation of the illumination element 618. The storage element 624, such as a capacitor, stores information from the serial protocol line 610 that passed through the access switch 620.

The illumination element 618, such as a light emitting diode (LED) of incoherent or coherent photon emission, provides the light for the display 600. The illumination element 618 may be implemented in a number of different configurations, such as a single light emitting diode, a string of light emitting diodes, a tree of light emitting diodes, or a matrix of light emitting diodes. In one embodiment, the illumination element 618 can further include a second LED string 619 connected in parallel with the first LED string 618 to a common signal source (not shown). Additionally, the second LED string 619 may include different color LED' s than the first LED string 618.

The access line 614 is connected to a gate terminal of the access switch 620. The serial protocol line 610 is connected to a source terminal of the access switch 620. A drain terminal of the access switch 620 is connected to a gate terminal of the illumination switch 622 and the storage element 624. The storage element 624 is also connected to a gate terminal of the illumination switch 622. A drain terminal of the illumination switch 622 is connected to an anode of the illumination element 618. A cathode of the illumination element 618 is connected to a voltage reference, such as a ground, having lower potential than that on the power line 608.

As mentioned earlier, the access line 614 includes the hybrid signal 612 having amplitude modulation and pulse width modulation. The luminance of the illumination element 618 may be controlled by the hybrid signal 612 on the serial protocol line 610. The illumination switch 622 is "on" or "off" for each scan of the display array 602. With the illumination switch 622 "on", the amplitude of the bias voltage from the serial protocol line 610 controls the current through the illumination element 618. As described in FIG. 3, $2^n$ scans of the display array 602 complete one pulse width modulation cycle. The number of "on" and "off" scans is determined by the pulse width modulation duty ratio. The pulse width modulation portion of the hybrid signal 612 may be applied as a global modulation to different types, such as different colors, of the illumination element 618 and apply amplitude modulation to the illumination element 618 of a single configuration or a configuration of substantially the same type, such as the same color. For example, the global modulation, such as the pulse width modulation, may be used for each green, red, and blue string of LEDs. At the same time, the amplitude modulation may be used to fine tune the wavelength of each string to improve the color uniformity.

The control blocks 604 may convert the display ingress information 226 and the display egress information 230 of FIG. 2 in the display control system 200 to the hybrid signal 612 by a number of different processes. The control blocks 604 may utilize the blocks of the display control system 200 in a number of different ways for the conversion process, as described in FIG. 3 and FIG. 4.

Figure 7:
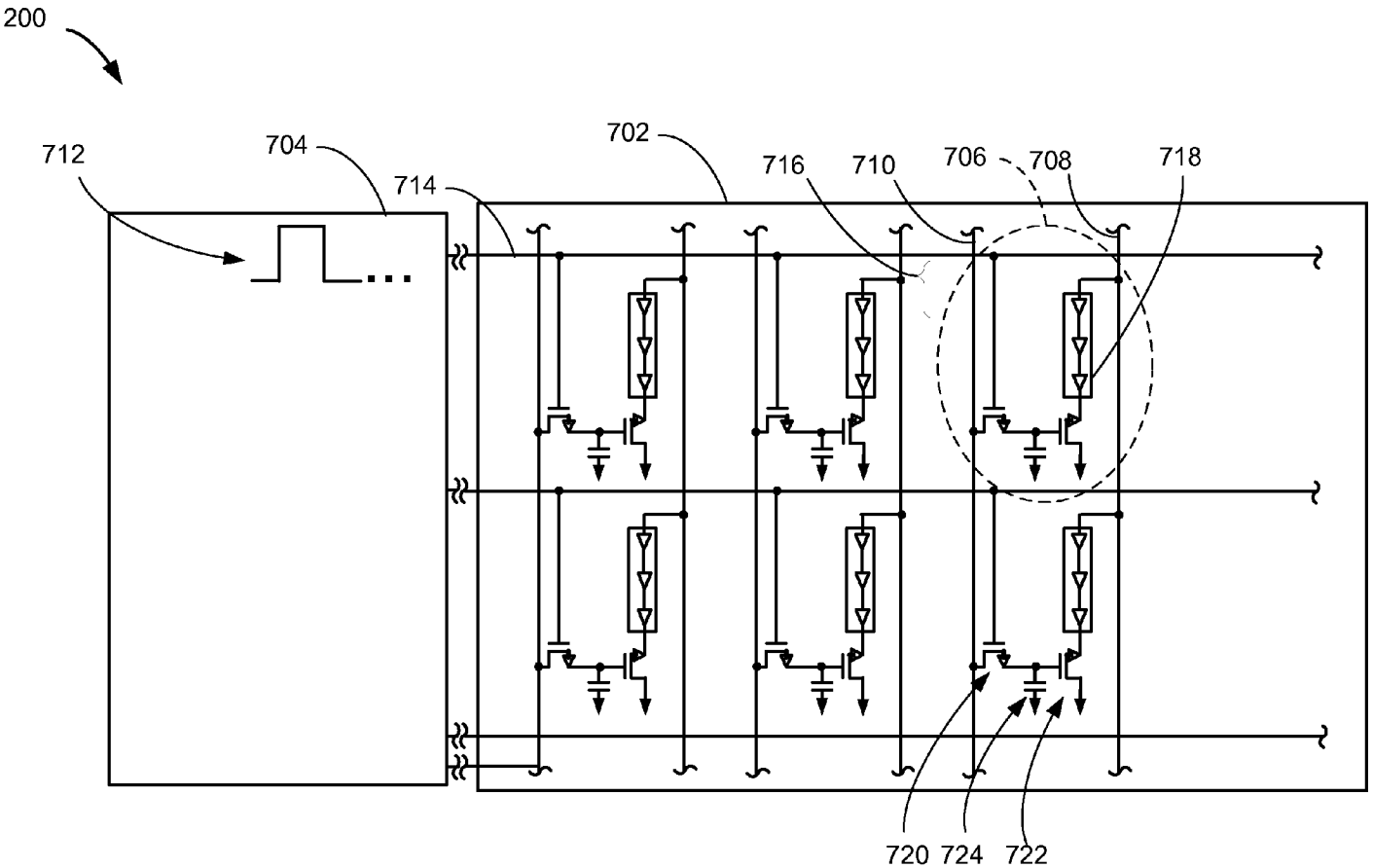
FIG. 7 is a more detailed view of a display in the display control system of FIG. 2 in yet still another embodiment of the present invention.

Referring now to FIG. 7, therein is shown a more detailed view of a display 700 in the display control system 200 of FIG. 2 in yet still another embodiment of the present invention. The display 700 may represent the display 204 of FIG. 2. A display array 702 is a portion of the display 700. Control blocks 704 may represent the control blocks 202 of FIG. 2 in the display control system 200.

The display array 702 has display units 706 in a matrix configuration. The display array 702 may be used to provide direct display or backlight for a display panel. A power line 708 and a serial protocol line 710 are connected to each of the display units 706. The serial protocol line 710 provides operational information, such as column address select, normal operation select, brightness information, test mode select, test data, calibration select, calibration data, as well as image information. The serial protocol line 710 may provide various information types or commands by a signal protocol recognized by the display units 706. The signal protocol may include a modulation scheme with varying duty cycles, amplitudes, levels, aperiodicity, frequencies, or a combination thereof. The signal protocol may include varying modulation schemes with structured sequences designating partitions in the signal protocol. One example of a signal for the serial protocol line 710 is a serial signal 712.

Each of the display units 706 is connected to an access line 714, such as a row address line, for enabling operation prescribed by the serial signal 712 on the serial protocol line 710. The serial signal 712 and the signal on the access line 714 are part of the display ingress information 226 of FIG. 2. The power line 708 is from the power supply 206 of FIG. 2.

The control blocks 704 generate the signals for the serial protocol line 710 and the access line 714. A communication link between the control blocks 704 and the display 700 includes the serial protocol line 710 and the access line 714, wherein the communication link carries a communication protocol.

Each of the display units 706 has activation elements 716 and an illumination element 718. The activation elements 716 include an access switch 720, an illumination switch 722, such as a current sink, and a storage element 724. The access switch 720, such as a field effect transistor (FET), provides or blocks access to the instance of the display units 706 for operation prescribed by the serial protocol line 710. The illumination switch 722, such as a field effect transistor (FET), provides or blocks activation of the illumination element 718. The storage element 724, such as a capacitor, stores information from the serial protocol line 710 that passed through the access switch 720.

The illumination element 718, such as a light emitting diode (LED) of incoherent or coherent photon emission, provides the light for the display 700. The illumination element 718 may be implemented in a number of different configurations, such as a single light emitting diode, a string of light emitting diodes, a tree of light emitting diodes, or a matrix of light emitting diodes.

The access line 714 is connected to a gate terminal of the access switch 720. The serial protocol line 710 is connected to a source terminal of the access switch 720. A drain terminal of the access switch 720 is connected to a gate terminal of the illumination switch 722 and an electrode of the storage element 724 and a gate terminal of the illumination switch 722. The other electrode of the storage element 724 is connected to a voltage reference, such as a ground, having lower potential than that on the power line 708. A source terminal of the illumination switch 722 is connected to a cathode of the illumination element 718. A drain terminal of the illumination switch 722 is connected to a voltage reference, such as a ground, having lower potential than that on the power line 708. An anode of the illumination element 718 is connected to a voltage reference, such as the power line 708.

The illumination element 718 connection to the power line 708 eliminates the variability of threshold voltage of the illumination switch 722. This configuration provides independent luminance control of the illumination element 718 improving the uniformity of the backlight. Lower power on the power line 708 may be used compared to the structure with the illumination element 718 connected to ground while allowing individual control of the illumination element 718. The lower power reduces the size of the illumination switch 722 and high voltage switching effects. Independent luminance control of the illumination element 718 may apply to dynamic backlight control improving the dynamic range and contrast of the display 700. The improved dynamic range allows for a wider tolerance in the acceptable range of the illumination element 718 eliminating the binning process and reducing cost.

Figure 8:
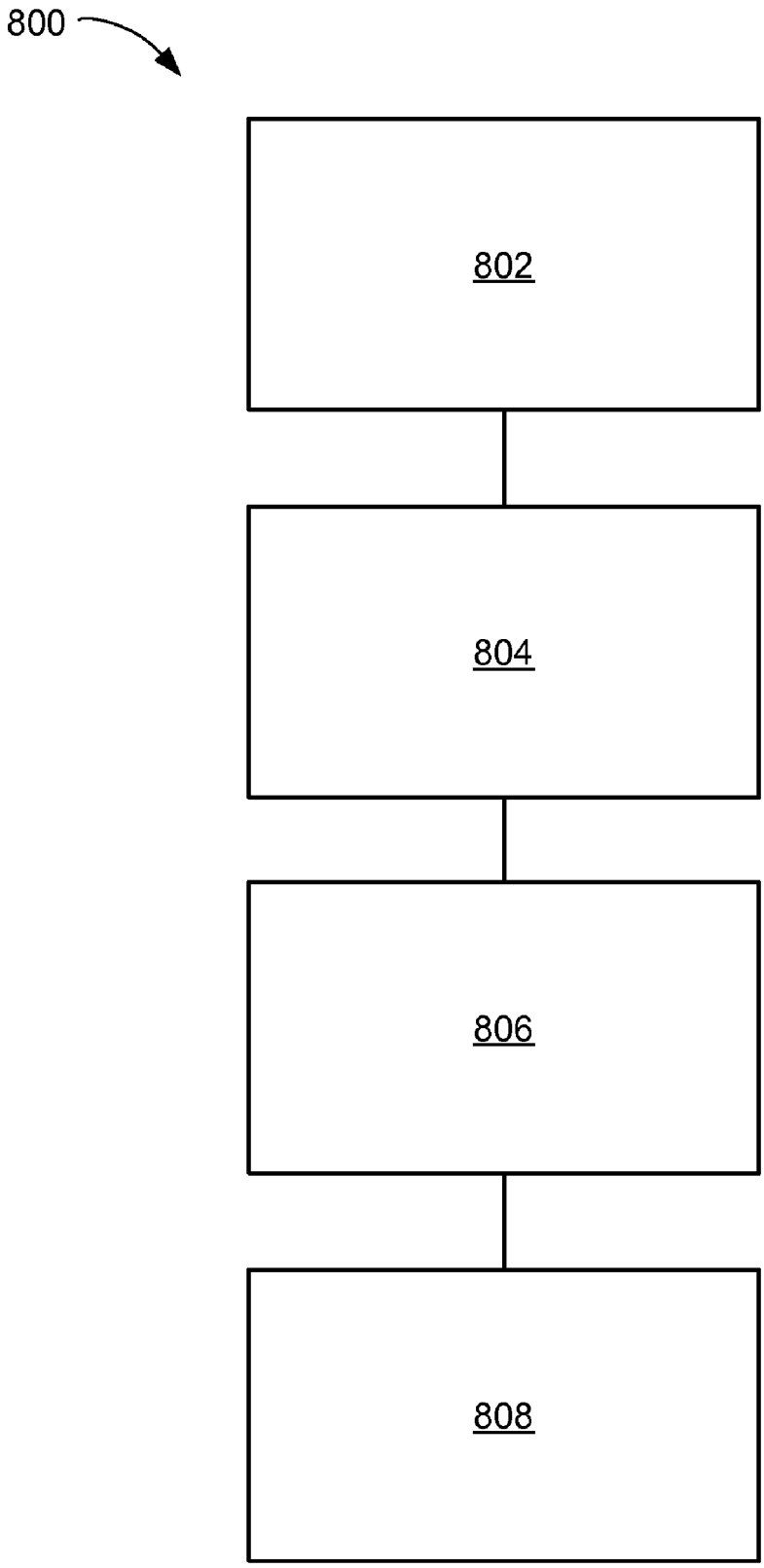
FIG. 8 is a flow chart of a display system for manufacture of the system in an embodiment of the present invention.

Referring now to FIG. 8, therein is shown a flow chart of a display system 800 for manufacture of the display system 100 in an embodiment of the present invention. The system 800 includes forming a display array in a block 802; connecting a control block to the display array in a block 804; configuring a communication protocol between the display array and the control block in a block 806; and operating the display array with the communication protocol in a block 808.

It has been discovered that the present invention thus has numerous aspects.

It has been discovered that the present invention provides low cost manufacture of display systems with improved uniformity and luminance control.

An aspect of the present invention provides a pulse width modulation for delivering charge to the storage capacitor in the display unit. The duty ratio of the pulse width modulation controls the charge stored for the addressed display units. The charge control provides luminance control.

Another aspect of the present invention provides an amplitude modulation for delivering charge to the storage capacitor in the display unit. The amplitude value may be adjusted to vary the charge stored for the addressed display units. The charge control provides luminance control.

Yet another aspect of the present invention provides a mixed modulation or a combination of modulation with pulse width modulation and amplitude modulation. This provides additional flexibility to control the charge stored and thereby further controlling luminance.

Yet another important aspect of the present invention provides implementing the storage element with an RC circuit, low pass filter. The low pass filter provides a more DC bias voltage to the current source for the light emitting diode.

Yet another important aspect of the present invention provides connecting the light emitting diode to power and a current sink to ground. This improves uniformity and eliminates variations of the current sink threshold voltage.

These and other valuable aspects of the present invention consequently further the state of the technology to at least the next level.

Thus, it has been discovered that the display system method of the present invention furnishes important and heretofore unknown and unavailable solutions, capabilities, and functional aspects for improving reliability in systems. The resulting processes and configurations are straightforward, cost-effective, uncomplicated, highly versatile, and effective, can be implemented by adapting known technologies, and are thus readily suited for efficiently and economically manufacturing integrated circuit package devices.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the scope of the included claims. All matters hithertofore set forth herein or shown in the accompanying drawings are to be interpreted in an illustrative and non-limiting sense.

What is claimed is:

1. A display system comprising:

forming a display unit having an access switch, a storage element, an illumination switch, and an illumination element, wherein forming the display unit having the illumination element includes forming a first string of first illumination elements of a first color and forming a second string of second illumination elements of a second color;

forming a display array with the display unit;

connecting a control block to the display array and the display unit;

configuring a signal protocol between the display unit and the control block to drive the display array;

addressing the access switch with the signal protocol;

storing information from the signal protocol and through the access switch onto the storage element;

controlling the illumination switch with the storage element; and activating the illumination element with the illumination switch, wherein activating the illumination switch includes applying a pulse width modulation for the signal protocol to the first string and the second string, applying an amplitude modulation for the signal protocol to the first string, and applying the amplitude modulation for the signal protocol to the second string.

2. The system as claimed in claim 1 wherein forming the display unit having the access switch and the illumination switch includes:

forming the access switch with a transistor; and forming the illumination switch with a transistor.

3. The system as claimed in claim 1 wherein forming the display unit having the storage element includes:

forming a capacitor;

connecting a first electrode of the capacitor to a gate terminal of the illumination switch;

connecting a second electrode of the capacitor to a source terminal of the illumination switch; and connecting a drain terminal of the illumination switch to the illumination element.

4. The system as claimed in claim 1 wherein forming the display unit includes:

connecting a capacitor to a gate terminal of the illumination switch;

connecting a source terminal of the illumination switch to the illumination clement; and connecting a drain terminal of the illumination switch to a ground reference.

5. The system as claimed in claim 1 wherein storing the information from the signal protocol and through the access switch onto the storage element includes operating a finite state machine in the control block for performing the signal protocol.

6. The system as claimed in claim 1 further comprising operating a controller in the control block for directing other blocks in the control block for performing the signal protocol.

7. The system as claimed in claim 1 wherein configuring the signal protocol includes configuring a protocol with pulse width modulation and amplitude modulation.

8. The system as claimed in claim 1 wherein forming the display unit having the illumination element includes forming a pixel in the display unit.

9. The system as claimed in claim 1 wherein forming the display unit having the illumination clement includes forming multiple pixels in the display unit.

10. The system as claimed in claim 1 wherein forming the display unit having the illumination element includes:

forming a tree or a matrix configuration with a light emitting diode;

accessing individually the light emitting diode with the signal protocol; and accessing a predetermined portion of the tree or matrix configuration of the light emitting diode with the signal protocol.

11. A display system comprising:

a display unit;

an access switch in the display unit;

a storage clement in the display unit;

an illumination switch in the display unit;

an illumination element in the display unit, wherein the illumination element includes a first string of first illumination elements of a first color and a second string of second illumination elements of a second color;

a display array with the display unit;

a control block connected to the display array and the display unit;

a configuration circuitry for a signal protocol between the display unit and the control block;

an access line connected to the access switch for storing information from the control block and connected through the access switch onto the storage element for controlling the illumination switch and for activating the illumination element with the illumination switch; and a hybrid modulation circuitry in the control block for generating pulse width modulation and amplitude modulation for the signal protocol with the signal protocol applied to the first string and the second string.

12. The system as claimed in claim 11 wherein the access switch is a transistor.

13. The system as claimed in claim 11 wherein the illumination switch is a transistor.

14. The system as claimed in claim 11 wherein the storage clement in the display unit is:

a capacitor;

a first electrode of the capacitor connected to a gate terminal of the illumination switch;

a second electrode of the capacitor connected to a source terminal of the illumination switch; and a drain terminal of the illumination switch connected to the illumination element.

15. The system as claimed in claim 11 wherein the display unit further comprises:

a capacitor connected to a gate terminal of illumination switch;

a source terminal of the illumination switch connected to the illumination clement; and a drain terminal of the illumination switch connected to a ground reference.

16. The system as claimed in claim 11 further comprising a program input/output block in the control block for performing the signal protocol.

17. The system as claimed in claim 11 further comprising a finite state machine in the control block for performing the signal protocol.

18. The system as claimed in claim 11 further comprising an operational amplifier in the control block for performing the signal protocol.

19. The system as claimed in claim 11 further comprising a controller in the control block for directing other blocks in the control block for performing the signal protocol.

20. The system as claimed in claim 11 further comprising a pulse width modulation circuitry in the control block for generating the signal protocol.

21. The system as claimed in claim 11 further comprising an amplitude modulation circuitry in the control block for generating the signal protocol.

22. The system as claimed in claim 11 further comprising a hybrid modulation circuitry in the control block for generating pulse width modulation and amplitude modulation for the signal protocol.

23. The system as claimed in claim 11 wherein the illumination element is a pixel in the display unit.

24. The system as claimed in claim 11 wherein the illumination clement has multiple pixels in the display unit.

25. The system as claimed in claim 11 wherein the illumination element is a tree or a matrix configuration with a fight emitting diode connected with the signal protocol for individually accessing the light emitting diode and for accessing a predetermined portion of the tree or matrix configuration of the light emitting diode.

* * * * *

UNITED STATES PATENT AND TRADEMARK OFFICE

CERTIFICATE OF CORRECTION

PATENT NO. : 7,928,939 B2
APPLICATION NO. : 11/677656
DATED : April 19, 2011
INVENTOR(S) : Jerry Chung et al.

It is certified that error appears in the above-identified patent and that said Letters Patent is hereby corrected as shown below:

In column 6, line 66, delete "Althernatively," and insert -- Alternatively, --, therefor.

In column 16, line 12, in claim 1, delete "clement," and insert -- element, --, therefor.

In column 16, line 25, in claim 1, delete "clement;" and insert -- element; --, therefor.

In column 16, line 26-27, in claim 1, delete "clement;" and insert -- element; --, therefor.

In column 16, line 54, in claim 4, delete "clement;" and insert -- element; --, therefor.

In column 17, line 5, in claim 9, delete "clement" and insert -- element --, therefor.

In column 17, line 19, in claim 11, delete "clement" and insert -- element --, therefor.

In column 17, line 44, in claim 14, delete "clement" and insert -- element --, therefor.

In column 18, line 10, in claim 15, delete "clement;" and insert -- element; --, therefor.

In column 18, line 38, in claim 24, delete "clement" and insert -- element --, therefor.

Signed and Sealed this
Sixth Day of December, 2011

David J. Kappos

David J. Kappos
*Director of the United States Patent and Trademark Office*